US007380522B2

(12) United States Patent
Krell et al.

(10) Patent No.: US 7,380,522 B2
(45) Date of Patent: Jun. 3, 2008

(54) ENERGY SAVING WATER HEATER

(75) Inventors: Anthony Krell, Prattville, AL (US); James York, Gray, TN (US); Timothy J. Shellenberger, Tyrone, GA (US)

(73) Assignee: American Water Heater Company, Atlanta, GA (US)

( * ) Notice: Subject to any disclaimer, the term of this patent is extended or adjusted under 35 U.S.C. 154(b) by 141 days.

(21) Appl. No.: 11/243,543

(22) Filed: Oct. 5, 2005

(65) Prior Publication Data

US 2007/0084419 A1 Apr. 19, 2007

(51) Int. Cl.
*F24H 9/20* (2006.01)

(52) U.S. Cl. ..... 122/14.2; 122/14.22

(58) Field of Classification Search ..... 122/14.2, 122/14.22; 219/485, 509, 510; 392/463, 392/464

See application file for complete search history.

(56) References Cited

U.S. PATENT DOCUMENTS 5,968,393 A * 10/1999 Demaline ..... 219/492
6,350,967 B1 * 2/2002 Scott ..... 219/497
6,560,409 B2 5/2003 Troost, IV
6,877,462 B2 * 4/2005 Adams et al. ..... 122/14.1
6,880,493 B2 * 4/2005 Clifford ..... 122/14.22
7,032,542 B2 * 4/2006 Donnelly et al. ..... 122/14.2
7,117,825 B2 * 10/2006 Phillips ..... 122/4 A

* cited by examiner

*Primary Examiner*—Gregory A Wilson
(74) *Attorney, Agent, or Firm*—DLA Piper US LLP

(57) ABSTRACT

A water heater including a water reservoir container having a cold water inlet and a hot water outlet, a combustion chamber adjacent the water container, a burner associated with the container; a temperature probe associated with the container that detects a water temperature in an upper portion of the container, and a controller that activates the burner, the controller establishing an initial water temperature set point, comparing detected water temperature with the set point when the burner is activated, reducing the set point by a first selected amount when the water temperature decreases by less than a selected amount while the burner is activated or increasing the set point by a second selected amount when the water decreases by a selected amount of more while the burner is activated.

35 Claims, 3 Drawing Sheets

ENERGY SAVING WATER HEATER

FIELD OF THE INVENTION

1. Technical Field

This disclosure relates to water heaters. In particular, this disclosure relates to water heaters having an electronic control system.

2. Background

In one aspect, a water heater includes a water container/tank and a burner to heat the water in the tank. A water heater may also include a controller for regulating the burner. By regulating the burner, the controller at least partially determines the hot water output of the water heater. For example, when the controller is associated with a temperature monitoring probe within the container and a thermostat, it may relate a sensed parameter such as water temperature with a control parameter such as a predetermined temperature range to determine whether operation of the burner is needed to achieve a desired hot water output.

For a gas water heater, the controller may comprise a gas valve. For example, the gas valve may act as a switch for turning the burner on and off. The gas valve may also be controlled electronically to operate according to a control algorithm. For example, a control algorithm may be designed for regulating operation of the heating element to meet various environmental and/or efficiency targets.

During the heating cycle in a typical storage-type water heater, hot water tends to rise to the top of the tank and cold water tends to settle at the bottom. The amount of difference in temperature between the top of the tank and the bottom is affected by many parameters including the placement of the temperature monitoring probe, output and size of the burner, the material composition of the tank and/or combustion compartment, the rate and frequency of water usage and the like. This difference in temperature between the top of the tank and the bottom is commonly referred to as "stacking."

Stacking is prominent in conditions where the hot water supply is cycled on and off frequently, that is, where the hot water is drawn to point where the burner is activated by the controller, and then the water is turned off shortly thereafter. In this situation, a substantial amount of standby hot water already exists in the tank. The application of further heat magnifies the stacking problem by further raising the temperature of the water at the top portion of the tank. As such, continuous cycling over a prolonged period can create further unwanted stacking.

As one might infer, placement of the temperature monitoring probe, cold water intake and hot water exit within the tank are factors that influence stacking. Currently, a significant amount of development time is spent in identifying locations to place these elements within the tank that will trade off hot water capacity against a maximum desirable water temperature under worst case stacking conditions.

One method for controlling stacking is disclosed in U.S. Pat. No. 6,560,409 to Troost. Troost describes a method wherein the frequency of removal of water from a water heater is monitored and related to water temperature to control the operation of a heating element. For example, the temperature control set point may be depressed or reset in response to a water temperature condition in the tank and the frequency of water removal over a time period. While suitable for its intended purpose, it would be advantageous to extend the methods to control stacking in Troost to applications that will increase the hot water output and energy efficiency of a typical water heater.

For example, while it is desirable to control stacking, it is also desirable to add cold water to the lowest portion of tank as possible to maximize hot water output. The endurance of a water heater with respect to its ability to sustain hot water output is measured as its "first hour" rating. Minimizing the mixing of the intake cold water with the heated water at the top of the tank will maximize the first hour rating. However, to increase the hot water provided while avoiding adverse conditions, additional advances in controlling stacking should be achieved.

SUMMARY

We provide a water heater including a water container having a cold water inlet and, a hot water outlet, a combustion chamber adjacent the water container, a burner associated with the container, a temperature sensor associated with the container that detects water temperature in an upper portion of the container, and a controller that activates the burner, the controller establishing an initial water temperature set point, comparing detected water temperature with the set point when the burner is activated, reducing the set point by a first selected amount when the water temperature decreases by less than a selected amount while the burner is activated or increasing the set point by a second selected amount when the water decreases by a selected amount or more while the burner is activated.

We also provide a method of controlling a water heater including detecting water temperature in an upper portion of a water container in the water heater, establishing an initial water temperature set point, comparing detected water temperature with the set point when a burner of the water heater is activated, reducing the set point by a first selected amount when the water temperature decreases by less than a selected amount while the burner is activated or increasing the set point by a second selected amount when the water decreases by a selected amount or more while the burner is activated.

We further provide a water heater including a water container having a cold water inlet, a hot water outlet, and a combustion chamber adjacent the water container, a dip tube connected to the cold water inlet and extending downwardly from a top portion of the water container and having a length that is between about 85% and about 90% of the height of the water container, a burner associated with the combustion chamber, an upper sensor associated with the water container that detects water temperature in an upper portion of the water container, a lower temperature sensor associated with the water container that detects water temperature in a lower portion of the water container; and a controller that activates the burner in response to temperature sensed by the upper and lower sensors.

DETAILED DESCRIPTION

Figure 1A:
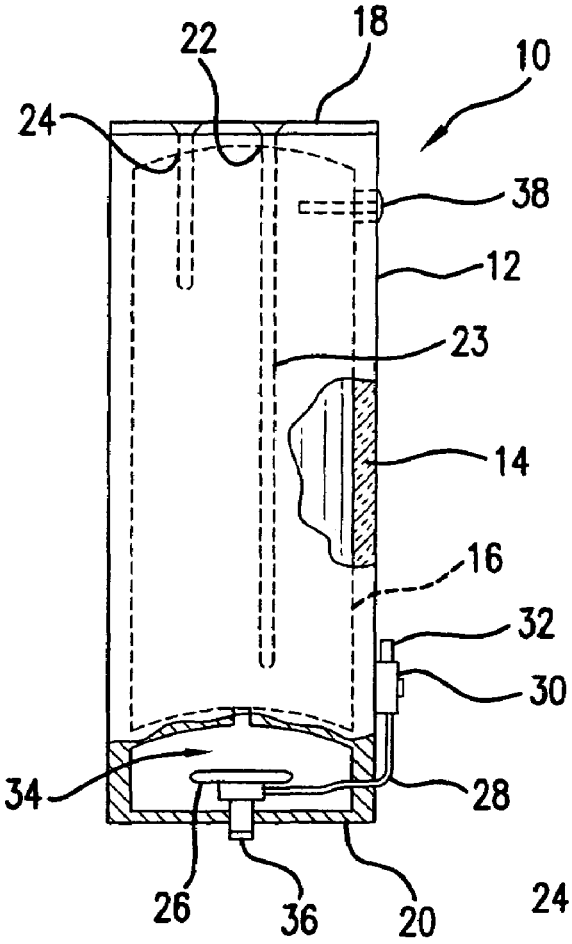
FIG. 1*a* is a schematic partial sectional view of a water heater which emphasizes certain features of the water heater and omits others for ease of understanding.

It will be appreciated that the following description is intended to refer to specific aspects of our water heaters selected for illustration in the drawings and is not intended to define or limit those water heaters, other than in the appended claims.

Turning now to the drawings generally and FIGS. 1 and 2, in particular, an environment for the implementation of aspects is shown which includes a water heater 10. One skilled in the art will appreciate that the water heater 10 comprises several components, some of which are shown and some of which are not. These additional water heater 10 components, while relevant to operation of the water heater 10, are not particularly pertinent to the description herein and, as such, are not described herein.

Water heater 10 includes an outer jacket 12, which surrounds foam insulation 14. The foam insulation 14 surrounds a water tank 16. A top pan 18 caps the jacket 12 on its upper end and a bottom pan 20 caps the jacket 12 on its lower end. An inlet 22 in the upper portion of the tank 16 provides for cold water to enter the tank 16 through, for example, an inlet tube 23. Similarly, an outlet 24 allows for hot water to exit through the upper portion of the tank 16.

The water heater 10 further includes a burner 26. The burner 26 may comprise any commercially available burner. The burner 26 is positioned to receive fuel from a fuel line 28, which connects to a gas valve 30, which connects to a fuel supply line 32 connected to a fuel supply that is not shown. Burner 26 may be further positioned within a combustion chamber 34 and above an air intake opening 36 in the bottom pan 20 to receive combustion air.

Figure 1B:
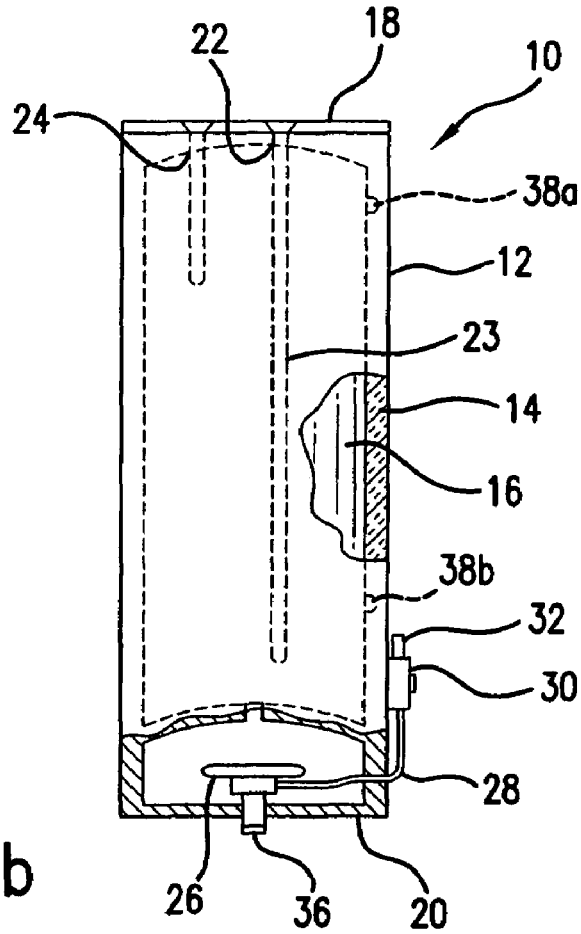
FIG. 1*b* is a schematic partial sectional view of the water heater of FIG. 1*a* having an additional temperature sensor.
Figure 2A:
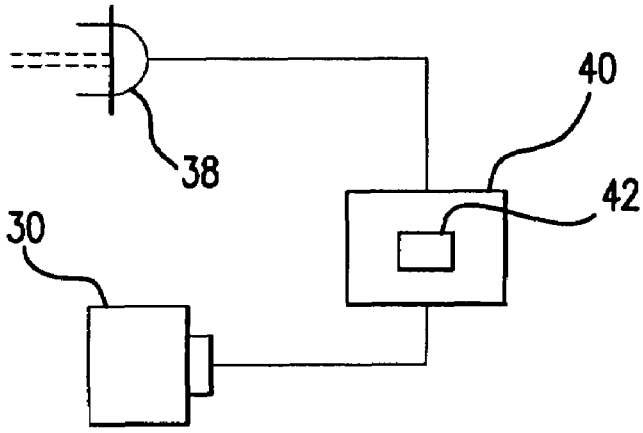
FIG. 2*a* is a schematic frontal view of a controller associated with the water heater shown in FIG. 1 and connected to a tank internal temperature sensor.
Figure 2B:
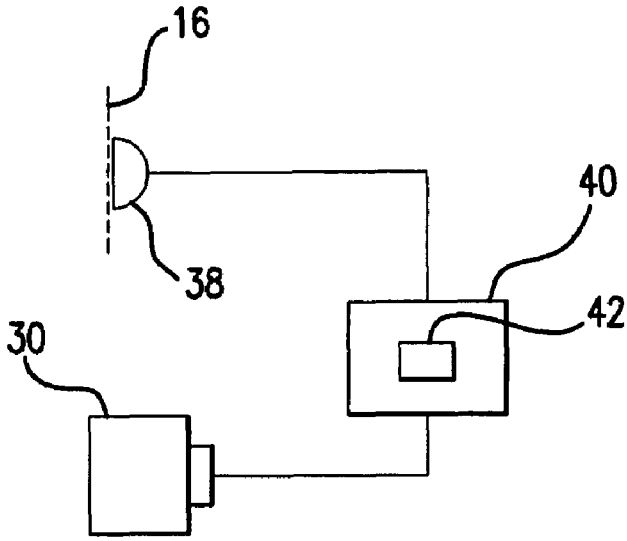
FIG. 2*b* is a schematic frontal view of a controller associated with the water heater shown in FIG. 1 and connected to a tank external temperature sensor.

A temperature monitoring sensor 38, shown in FIGS. 1 and 2, is associated with the tank 16 for monitoring the temperature of water in the tank 16. The temperature monitoring sensor 38 may be positioned to monitor the temperature of the water in the upper portion of the tank 16 as shown in FIG. 1*a*, as an example. Sensor 38 may be internal to tank 16 as shown in FIG. 2*a* or external. For example, a thermistor can be used on the outside of tank 16 as shown in FIG. 2*b*. Any type of sensor may be used such as thermocouples, RTD's, bimetals and the like. The temperature monitoring sensor 38 further provides information related to the frequency of hot water removal from the tank 16. For example, a decrease in water temperature at the upper portion of the tank 16 may be correlated with the frequency of hot water removal from the tank 16.

A plurality of temperature monitoring sensors 38 may be associated with the tank 16 as shown in FIG. 1*b*, as an example. For example, the plurality of temperature monitoring sensors 38 may be electrically linked together to monitor the water temperatures in upper and lower portions of the tank 16 relative to each other. A plurality of temperature monitoring sensors 38 may be utilized to average the water temperatures in various portions of the tank 16.

The upper sensor helps monitor and control stacking and facilitates lengthening the dip tube for more hot water delivery. Tables 1 and 2 below shows the effect of lengthened dip tubes. Thus, it is advantageous to have the length of the dip tube be within about 85%—about 90% of the tank height.

TABLE 1

| | | Water Inlet Dip tube Length | | | | |
|---|---|---|---|---|---|---|
| Model | Tank Ht (in) | Std Dip tube Length (ind) | Invention Dip tube Length (in) | Invention Dip tube Increase % | Std Dip tube % Tank Ht | Invention Dip tube % Tank Ht |
| 40 Gallon | 47.5 | 34 | 42 | 24 | 72 | 88 |
| 50 Gallon | 46.25 | 34 | 42 | 24 | 74 | 91 |

TABLE 2

| Model | First Hour Recovery Std | First Hour Recovery Invention | % Improvement |
|---|---|---|---|
| 40 Gallon | 69 | 79 | 14.5 |
| 50 Gallon | 80 | 91 | 13.75 |

A controller 40, shown in FIG. 2, is associated with a fuel control element such as gas valve 30 and is utilized to receive signals indicative of water temperature and the frequency of water removal. Controller 40 subsequently sends signals to control the operation of the heating element 26. For example, the frequency of water removal may be signaled by monitoring decreases in water temperature at the upper portion of the tank 16. Such temperature monitoring is achieved by temperature monitoring sensor 38. Alternatively, the frequency of water removal may be monitored directly or by other means well known to those skilled in the art such as, for example, water flow or water pressure monitoring.

The controller 40 may include a microprocessor 42. One example of microprocessor 42 may be of the type disclosed in U.S. Pat. No. 6,560,409, the subject matter of which is incorporated herein by reference. Other microprocessors may be employed.

The microprocessor 42 may be operable to receive selected inputted information such as, for example, water temperature information from the temperature monitoring sensor 38. The microprocessor 42 may be pre-programmed and/or programmable to set and/or adjust the temperature control set point based on the inputted information. For example, the microprocessor 42 may be pre-programmed and/or programmable to continuously vary the temperature control set point when the water temperature is within a predetermined range. The microprocessor 42 may be further pre-programmed and/or programmable to adjust the temperature control set point on a selected basis depending on various local conditions and parameters for a particular water heater 10. The microprocessor 42 may carry out thermostat functions for the controller 40 by providing signals to activate and/or deactivate the burner 26 according to a pre-programmed and/or programmable control algorithm.

An example of the system operation is now described. The microprocessor 42 may be pre-programmed and/or programmable to adjust the temperature control set point as a function of water usage. The microprocessor may include two operating modes. In a first standard operating mode, the microprocessor 42 is operable to set or maintain a user-selectable temperature control set point. In a second energy saver operating mode, the microprocessor is operable to regulate the temperature control set point according to a control algorithm. For example, the second operating mode may be activated during periods when the burner is activated. In the second operating mode, the microprocessor may receive signals indicating the water temperature from the temperature monitoring sensor 38. If the water temperature drops by less than 10° F. while the burner 26 is activated, the microprocessor 42 will reduce the temperature control set point by 2° F. If the water temperature drops by more than 10° F. while the burner 26 is on, the microprocessor 42 will increase the temperature control set point by 3° F. The microprocessor may be further pre-programmed and/or programmable to prevent the new set point from being permitted to exceed the initial set point or fall below a predetermined minimum set point. For example, the minimum temperature control set point may be 115° F. The initial set point, minimum set point and the predetermined magnitudes for adjusting the set point may be user-selectable.

The temperature control set point may be continuously variable and thus, lower on average to minimize the conditions in which stacking may occur in the tank 16. This second energy saving operating mode may reduce heat loss by up to about 30 percent when hot water demand is low for a gas water heater. The microprocessor 42 may also be pre-programmed and/or programmable to continuously vary the temperature control set point more or less, or for different water temperature ranges than those described above.

Figure 3:
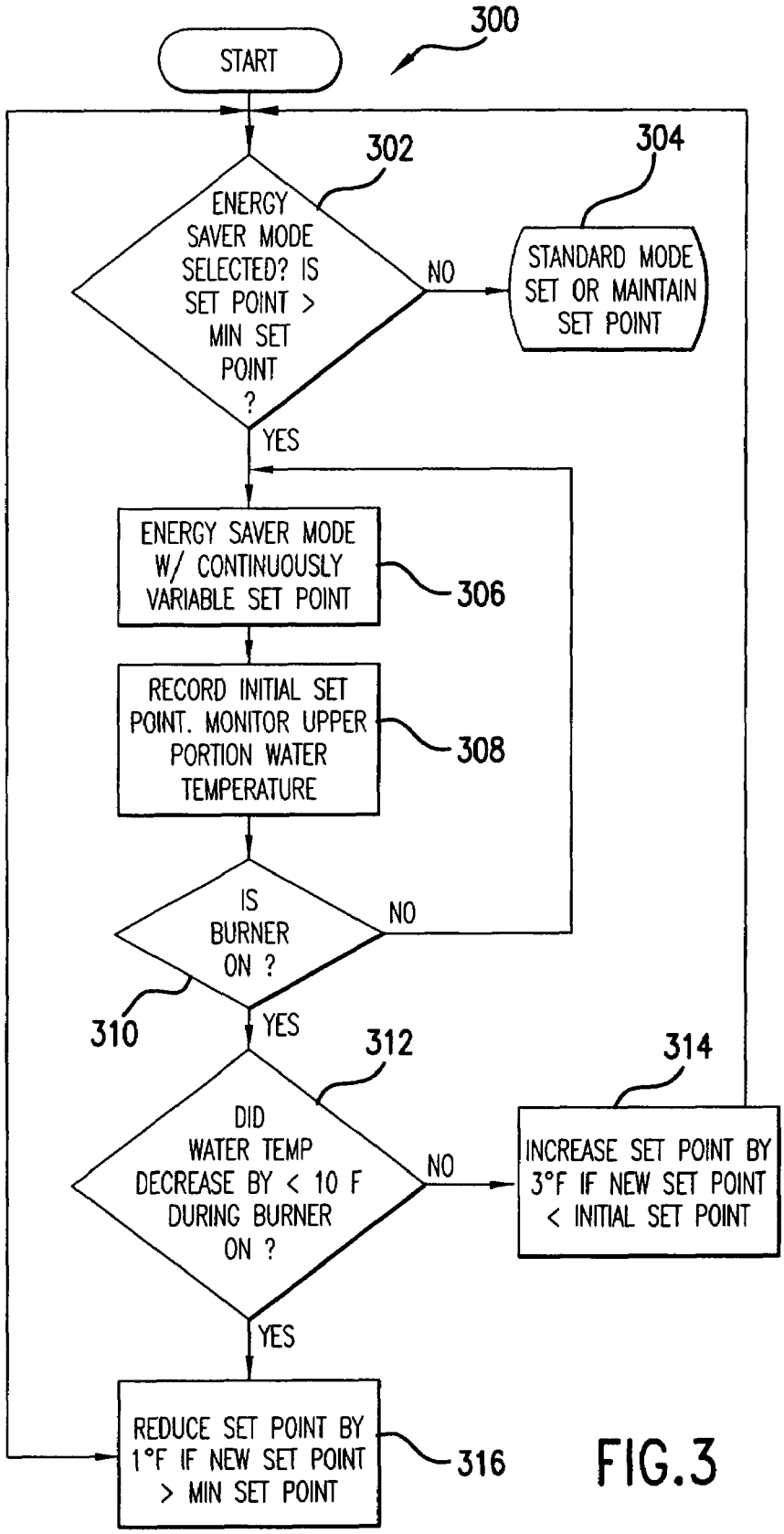
FIG. 3 is a flow diagram which illustrates the operation of various aspects of the invention.

FIG. 3 is a flow diagram which illustrates one example of the operation. While the microprocessor 42 may perform operations herein, another element or a combination of elements may also be operable to perform some or all of the operations described. As such, the flow diagram should be understood as only one example for implementing aspects this disclosure.

The plot 300 begins at step 302 wherein the microprocessor 42 determines whether a first or second operating mode is selected and whether the temperature control set point is above a minimum set point. For example, the minimum set point may be 115° F. If the microprocessor 42 is set to a first operating mode or the temperature control set point is below the minimum set point, the microprocessor 42 will operate in a first operating mode wherein the microprocessor is operable to set and maintain a temperature control set point for the burner 26 at step 304.

If the second operating mode of the microprocessor 42 is selected and the temperature control set point is above a minimum set point, the microprocessor 42 will be operable to continuously vary the temperature control set point within a predetermined/selected water temperature range at step 306 by first recording the initial set point at step 308 and monitoring the water temperature versus the set point during a period when the burner is on at step 310. For example, the temperature monitoring sensor 38 may be associated with the microprocessor 42 for monitoring the water temperature in the tank 16. If the burner 26 is not on, the microprocessor 42 will maintain the temperature control set point until a burner 26 is on period and stand by in the selected mode.

When the burner 26 is on at step 312, the microprocessor 42 determines whether the water temperature has decreased less than a predetermined magnitude. For example, the predetermined magnitude may be 10° F. or any magnitude determined to represent a selected flow rate of hot water out of the tank 16 and for which an adjustment in the set point is determined to be desirable. If the water temperature decreases by less than a predetermined magnitude, the microprocessor 42 increases the temperature control set point by a predetermined amount up to the initial set point at step 314. If the water temperature decreases by more than a predetermined amount, the microprocessor 42 reduces the temperature control set point by a predetermined amount down to a minimum set point at step 316.

The control algorithm makes it possible to associate the cold water intake with the bottom portion of the water tank to increase hot water output. For example, the cold water intake may be an inlet tube associated with the bottom portion of the tank 16 designed to allow a minimum amount of cold water mixing with the heated water in the upper portion of the tank. The cold water inlet associated with the bottom portion of the tank improves hot water recovery by as much as about an additional 15 percent over the standard mode in conjunction with the control algorithm.

Our water heaters may also be equipped to monitor/check for so-called "dry-fire" conditions. In such a case, when the gas valve 30 is activated when there is a call for a need to heat water, the controller 40 activates burner 26 for about a 1 to 2 minute period of time. The activation period is based on tank thickness, burner location and sensor position, among other things. The controller monitors the lower sensor 38*b* (as opposed to the upper sensor 38*a*). If the lower thermistor temperature increases at a rate higher than a set rate such as 3° F. per minute, then controller 40 shuts gas valve 30 off, which also shuts off main burner 26. The controller 40 can flash a so-called "error" code or provide other means of notification or alarm. The 3° F. degrees per minute rate of increase is also based on tank thickness, burner location and thermistor position. This indicates that the tank is dry under such a condition and that there is a problem with the water heater unit.

Although our water heaters have been described in connection with specific forms thereof, it will be appreciated that a wide variety of equivalents may be substituted for the specified elements described herein without departing from the spirit and scope of this disclosure as described in the appended claims. For example, water tank 16 may be made of a number of sizes and may be made from a wide variety of materials such as metals and/or plastics. Foam insulation 14 may similarly be made from any number of high energy efficient foam insulations well known in the art.

Also, the bottom of the water tank 16 may have various shapes, either with lower flanges as shown or as a flat construction. Other modifications may be made, including use of foam insulation between the bottom of tank 16 and bottom pan 20. Also, outer jacket 12 may be made from any number of materials such as rolled metals, preferably steel, or extruded vinyl materials and the like. Also, top pan 18 and bottom pan 20 may be deep-drawn, stamped or the like, or be made from metal, plastic or other suitable materials. Various types of heating elements may be utilized so long as they are used in conjunction with sensors 38.

The adjustment temperatures for the set point and the conditions necessary for set point adjustment are fully variable and the values used herein are examples for illustration purposes only. One skilled in the art will note that many set point usage combinations are possible without varying from the spirit and scope of the disclosure.

The invention claimed is:

1. A method of controlling a water heater comprising:

detecting water temperature in an upper portion of a water container in the water heater;

establishing an initial water temperature set point;

comparing detected water temperature with the initial set point when a burner of the water heater is activated; and adjusting the initial set point based upon the comparison and as a function of water usage in the water heater, comprising:

(i) reducing the initial set point by a first selected amount to a reduced set point when the water temperature decreases by less than a selected amount while the burner is activated; or (ii) increasing the initial set point by a second selected amount to an increased set point when the water temperature decreases by the selected amount or more while the burner is activated;

wherein neither the reduced set point nor the increased set point are equal to the initial set point.

2. The method of claim 1, wherein the temperature control set point is continuously adjusted within a predetermined range.

3. The method of claim 2, further comprising recording an initial temperature control set point.

4. The method of claim 3, further comprising selecting the initial temperature control set point as a maximum temperature control set point.

5. The method of claim 2, further comprising selecting a minimum temperature control set point.

6. The method of claim 1, wherein the temperature control set point is adjustable by a predetermined magnitude.

7. The method of claim 6, wherein the temperature control set point is increased by 3° F. when the water temperature decreases by more than 10° F.

8. The method of claim 6, wherein the temperature control set point is decreased by 2° F. when the water temperature decreases by less than 10° F.

9. The method of claim 1, further comprising a dip tube extending downwardly from a top portion of the water container and having a length that is between about 85% and about 90% of the height of the water container.

10. The method of claim 1, further comprising a lower sensor associated with the water container and connected to the controller.

11. The method of claim 10, further comprising first initiating activation of the burner for a selected time, monitoring temperature sensed by the lower sensor, shutting off the burner if the sensed temperature increases at a rate per minute that is higher than a selected rate and generating an alarm.

12. The method of claim 11, wherein the selected time is about 1 to about 2 minutes.

13. The method of claim 11, wherein the selected rate is about 3° F. per minute.

14. The method of claim 10, wherein the lower sensor is a thermistor.

15. The method of claim 1, wherein the upper sensor is a thermistor.

16. The method of claim 1, wherein the sensors are positioned external of the water container.

17. The method of claim 1, wherein, when the burner is activated, monitoring a water temperature related to the frequency of water removal from said reservoir to continuously adjust a temperature control set point.

18. A water heater comprising:

a water container having a cold water inlet, a hot water outlet, and a combustion chamber adjacent the water container;

a burner associated with the combustion chamber;

a temperature sensor associated with the water container that detects water temperature in an upper portion of the water container; and a controller that activates the burner, said controller establishing an initial water temperature set point, comparing detected water temperature with the initial set point when the burner is activated, and adjusting the initial set point based upon the comparison and as a function of water usage in the water heater, wherein adjusting comprises (i) reducing the initial set point by a first selected amount to a reduced set point when the water temperature decreases by less than a selected amount while the burner is activated or (ii) increasing the initial set point by a second selected amount to an increased set point when the water decreases by the selected amount or more while the burner is activated, wherein neither the reduced set point nor the increased set point are equal to the initial set point.

19. The water heater of claim 18, wherein the temperature control set point is continuously adjustable within a predetermined range.

20. The water heater of claim 18, wherein the initial set point is a maximum temperature control set point.

21. The water heater of claim 18, wherein the set point is a minimum temperature control set point.

22. The water heater of claim 18, wherein the set point is adjustable by a predetermined amount.

23. The water heater of claim 18, wherein the second selected amount is 3° F. when the water temperature decreases by more than 10° F.

24. The water heater of claim 18, wherein the first selected amount is 2° F. when the water temperature decreases by less than 10° F.

25. The water heater of claim 18, further comprising a lower sensor associated with the water container and connected to the controller.

26. The water heater of claim 25, wherein the lower sensor is a thermistor.

27. The water heater of claim 18, wherein the burner is first activated for a selected time, the lower sensor monitors water temperature, and the burner shuts off if the sensed temperature increases at a rate per minute that is higher than a selected rate and generating an alarm.

28. The water heater of claim 27, wherein the selected time is about 1 to about 2 minutes.

29. The water heater of claim 27, wherein the selected rate is about 3° F. per minute.

30. The water heater of claim 18, wherein the upper sensor is a thermistor.

31. The water heater of claim 18, wherein the sensors are positioned external of the water container.

32. The water heater of claim 18, further comprising a dip tube extending downwardly from a top portion of the water container and having a length that is between about 85% and about 99% of the height of the water container.

33. A water heater comprising:

a water container having a cold water inlet, a hot water outlet, and a combustion chamber adjacent the water container;

a dip tube connected to the cold water inlet and extending downwardly from a top portion of the water container and having a length that is between about 85% and about 99% of the height of the water container;

a burner associated with the combustion chamber;

an upper sensor associated with the water container that detects water temperature in an upper portion of the water container;

a lower temperature sensor associated with the water container that detects water temperature in a lower portion of the water container; and a controller that activates the burner in response to temperature sensed by the upper and lower sensors, said controller establishing an initial water temperature set point, comparing detected water temperature with the initial set point when the burner is activated, and adjusting the initial set point based upon the comparison and as a function of water usage in the water heater, wherein adjusting comprises (i) reducing the initial set point by a first selected amount to a reduced set point when the water temperature decreases by less than a selected amount while the burner is activated or (ii) increasing the initial set point by a second selected amount to an increased set point when the water decreases by the selected amount or more while the burner is activated, wherein neither the reduced set point nor the increased set point are equal to the initial set point.

34. The water heater of claim 33, wherein the length of the dip tube is between about 85% and about 90%.

35. A method of controlling a water heater comprising:

detecting water temperature in an upper portion of a water container in the water heater;

establishing an initial water temperature set point;

comparing detected water temperature with the initial set point when a burner of the water heater is activated; and adjusting the initial set point based upon the comparison and as a function of water usage in the water heater, comprising:

(i) changing the initial set point by a first selected amount to a reduced set point less than the initial set point when the water temperature decreases by less than a selected amount while the burner is activated; or (ii) changing the initial set point by a second selected amount to an increased set point greater than the initial set point when the water temperature decreases by the selected amount or more while the burner is activated.

* * * * *